US011239575B2

(12) United States Patent
Koellmann et al.

(10) Patent No.: US 11,239,575 B2
(45) Date of Patent: Feb. 1, 2022

(54) CONDUCTOR TERMINAL HAVING A BUSBAR PIECE AND A CLAMPING SPRING

(71) Applicant: WAGO VERWALTUNGSGESELLSCHAFT MBH, Minden (DE)

(72) Inventors: Hans-Josef Koellmann, Minden (DE); Michael Meyer, Wiedensahl (DE); Thomas Witte, Porta Westfalica (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/820,020

(22) Filed: Mar. 16, 2020

(65) Prior Publication Data

US 2020/0220279 A1 Jul. 9, 2020

Related U.S. Application Data

(60) Division of application No. 16/231,810, filed on Dec. 24, 2018, now Pat. No. 10,594,053, which is a (Continued)

(30) Foreign Application Priority Data

Jun. 24, 2016 (DE) ..... 10 2016 111 627.0

(51) Int. Cl.
*H01R 4/48* (2006.01)
*H01R 9/24* (2006.01)
*H01R 9/26* (2006.01)

(52) U.S. Cl.
CPC ..... *H01R 4/4836* (2013.01); *H01R 9/2408* (2013.01); *H01R 9/2675* (2013.01)

(58) Field of Classification Search
CPC .. H01R 9/2408; H01R 9/2675; H01R 4/4836; H01R 4/4809; H01R 4/4818
(Continued)

(56) References Cited

U.S. PATENT DOCUMENTS 6,336,824 B1 1/2002 Sorig
6,719,581 B2 * 4/2004 Kikuchi ..... H01R 4/4881 439/441
(Continued)

FOREIGN PATENT DOCUMENTS

DE 10 2004 045 026 B3 2/2006
DE 10 2005 048 972 A1 4/2007
(Continued)

OTHER PUBLICATIONS

International Search Report dated Jul. 20, 2017 in corresponding application PCT/EP2017/064932.
(Continued)

*Primary Examiner* — Marcus E Harcum
(74) *Attorney, Agent, or Firm* — Muncy, Geissler, Olds & Lowe, P.C.

(57) ABSTRACT

A conductor terminal with a busbar piece and a clamping spring. The clamping spring has a clamping limb which is oriented towards the busbar piece in order to form a clamping point for clamping an electric conductor between the clamping limb and the bus bar piece, a spring bracket which adjoins the clamping limb, and a contact limb, a vertical section of which extends transversely to the bus bar piece. The vertical section of the contact limb has a recess with edges which surround the bus bar piece. The bus bar piece has a contact wall which adjoins the wall surface of the contact limb vertical section extending transversely to the busbar piece. The wall surface lying on the vertical section side facing away from the clamping limb, and which is designed to support the vertical section of the contact limb on the contact wall.

28 Claims, 9 Drawing Sheets

Related U.S. Application Data continuation of application No. PCT/EP2017/064932, filed on Jun. 19, 2017.

(58) Field of Classification Search
USPC ..... 439/440, 441
See application file for complete search history.

(56) References Cited

U.S. PATENT DOCUMENTS

| | | | |
|---|---|---|---|
| 6,851,967 | B2 | 2/2005 | Miyoshi et al. |
| 7,175,469 | B1 | 2/2007 | Daily et al. |
| 7,329,143 | B2 | 2/2008 | Schrader |
| 7,651,363 | B2 | 1/2010 | Koellmann |
| 7,896,686 | B2 | 3/2011 | Hoppe |
| 8,251,738 | B2 | 8/2012 | Heckert et al. |
| 8,292,677 | B2 | 10/2012 | Gassauer |
| 8,408,952 | B2 | 4/2013 | Wu |
| 8,485,841 | B2 | 7/2013 | Schrader |
| 8,579,651 | B2 | 11/2013 | Hanning et al. |
| 8,794,994 | B2 | 8/2014 | Köllmann et al. |
| 8,851,920 | B2 | 10/2014 | Wu et al. |
| 9,373,899 | B2 | 6/2016 | Wu |
| 9,478,874 | B2 | 10/2016 | Stolze |
| 9,502,790 | B2 | 11/2016 | Kollmann et al. |
| 9,525,218 | B2 | 12/2016 | Wu et al. |
| 9,799,979 | B2 | 10/2017 | Kamo et al. |
| 9,899,752 | B2 | 2/2018 | Wu et al. |
| 2004/0248457 | A1 | 12/2004 | Walter |
| 2006/0063419 | A1 | 3/2006 | Steinkemper et al. |
| 2008/0020628 | A1 | 1/2008 | Kikuchi |
| 2017/0012368 | A1 | 1/2017 | Aboulkassem et al. |
| 2018/0248276 | A1* | 8/2018 | Kettern ..... H01R 4/4836 |
| 2018/0254568 | A1 | 9/2018 | Koellmann |

FOREIGN PATENT DOCUMENTS

| | | | |
|---|---|---|---|
| DE | 10 2009 004 513 | A1 | 7/2010 |
| DE | 10 2010 025 930 | A1 | 1/2012 |
| DE | 20 2013 100 635 | U1 | 3/2013 |
| DE | 10 2013 101 411 | A1 | 8/2014 |
| DE | 20 2015 003 298 | U1 | 6/2015 |
| DE | 10 2014 103 638 | A1 | 9/2015 |
| DE | 10 2015 119 247 | A1 | 5/2017 |
| EP | 2 434 581 | A1 | 3/2012 |
| WO | WO 2010/133082 | A1 | 11/2010 |

OTHER PUBLICATIONS

International Preliminary Report on Patentability dated Dec. 25, 2018 in corresponding application PCT/EP2017/064932.

* cited by examiner

A-A

CONDUCTOR TERMINAL HAVING A BUSBAR PIECE AND A CLAMPING SPRING

This nonprovisional application is a divisional of U.S. application Ser. No. 16/231,810 filed on Dec. 24, 2018, which is a continuation of International Application No. PCT/EP2017/064932, which was filed on Jun. 19, 2017, and which claims priority to German Patent Application No. 10 2016 111 627.0, which was filed in Germany on Jun. 24, 2016, and which are all herein incorporated by reference.

BACKGROUND OF THE INVENTION

Field of the Invention

The present invention relates to a conductor terminal comprising a busbar piece and a clamping spring, which has a clamping limb oriented toward the busbar piece to form a clamping point for clamping an electric conductor between the clamping point and the busbar piece, a spring bend adjoining the clamping limb and a contact limb, a vertical section of which extends transversely to the busbar piece. The vertical section of the contact limb has a recess with edges that surround the busbar piece.

Description of the Background Art

DE 10 2010 025 930 A1 shows a terminal having a clamping spring and a busbar piece. The contact insert formed from the clamping spring and busbar piece is installed in an insulator housing. The clamping spring is designed as an open loop and includes a contact limb and a clamping limb. The contact limb adjoins the current bar lengthwise. The current bar is guided through a recess of the clamping limb.

DE 10 2009 004 513 A1 discloses a conductor terminal, comprising a clamping spring and a receiving element bent in the shape of a U. The section adjoining the spring bend forms a bearing limb, which abuts the receiving element. A limiting limb is bent away from this bearing limb in the direction of a bracket of the receiving element, which together with the clamping limb forms a clamping point for clamping an electric conductor. The bearing limb includes a lug element, which is positionable in an opening of the receiving element surrounding the clamping spring for the purpose of fixing the limiting limb. The edge area of the limiting limb abuts the receiving element.

SUMMARY OF THE INVENTION

It is therefore an object of the present invention to provide an improved terminal, in which the clamping spring is connected to the busbar piece in a structurally easy and self-bearing manner, and the clamping spring is relatively stable and stiff.

In an exemplary embodiment, a conductor terminal is provided that includes that the busbar piece has a contact wall, which is situated adjacent to a wall surface of the vertical section of the contact limb, which is situated on the side of the vertical section facing away from the clamping limb. The contact wall is designed to support the vertical section of the contact limb with the wall surface facing away from the clamping limb. The vertical section of the contact limb forms a plane which is oriented perpendicularly to the main extension direction of the busbar piece. The main extension direction of the busbar piece is determined by the direction between a clamping section and the free end of a tuning fork contact socket opposite the clamping selection.

By supporting the vertical section of the contact limb on the busbar piece, which is inserted into the recess, and by supporting this vertical section on the side opposite the clamping limb, the clamping spring is accommodated and supported on the busbar piece in a stable and reinforcing manner. A self-supporting terminal insert is formed from the clamping spring and the busbar piece, in which the forces occurring during the clamping of an electric conductor or opening the clamping point are essentially captured in a closed system between the clamping limb and the busbar piece.

"Transversely" can be understood to mean that the vertical section is oriented to face the busbar piece. An exactly perpendicular arrangement at a 90° angle is not necessary.

By supporting the vertical section on the wall surface of the contact wall facing away from the clamping limb, a tilting of the clamping spring is changed when the clamping limb is moved away from the busbar piece.

The edges of the contact limb delimiting the recess are supported on the busbar piece in that these edges surround the busbar piece. The term "surround" can be understood to mean that the busbar abuts the edges of the recess on at least two sides. The recess may be designed as a bay which is open from at least one side. The edges of the recess abut, for example, the upper side and the two adjoining narrow side edges of the busbar piece or the upper side, one narrow side edge and the underside of the busbar piece.

A transverse web may be formed on the recess of the vertical section of the contact limb, which engages with the busbar piece from below. The busbar piece is then inserted into this recess. The edge of the vertical section, which is opposite the transverse web and which delimits the recess, is then supported on the busbar piece. With the aid of this transverse web and the edge opposite the transverse web, both of which delimit the recess, the contact limb is held on the busbar piece on the upper side and the underside of the busbar piece. The contact limb may be fixedly clamped into the busbar piece or be easily movable with a limited tolerance. In any case, the contact limb is fixed in place on the busbar piece in this manner.

The vertical section of the contact limb may have a notch at a distance from the transverse web. A finger inserted into the notch then projects away from the contact wall. Another position fixing point at a distance from the recess is thus provided at a distance from the recess of the contact limb, on which the clamping spring is supported on the busbar piece. A tilting of the clamping spring is prevented by the finger of the contact wall, which projects away from the contact wall and is inserted into the notch of the contact limb.

The finger may surround the vertical section of the contact limb, and its end may abut the side of the vertical section, which is opposite the contact surface of the vertical section on the contact wall. The contact limb is thus fixed in place on the contact wall, in that the contact limb abuts the wall surface of the contact wall facing away from the clamping limb, on the one hand, and abuts the finger on the side of the contact limb facing the clamping limb, on the other hand.

A horizontal section of the contact limb may be bent away from the vertical section in the main extension direction of the busbar piece. This horizontal section is disposed at a distance from the busbar piece and transitions into the spring bend. A spring arm is thus provided at a distance from the busbar, which is supported in a very stable manner by the vertical section. This horizontal section makes it possible to relieve the load on the clamping spring when the latter is opened, e.g. in connection with an actuating lever, and to provide a soft spring for opening the clamping point. For this purpose, a pressure acting upon the horizontal section is reduced or canceled out by an actuating lever. In the closed state, however, the actuating lever may be supported on the horizontal section, so that a much stiffer clamping spring is provided.

The horizontal section of the contact insert formed from the busbar piece and the clamping spring may be exposed without a surrounding insulator housing and not be supported on the busbar piece. The only support for the horizontal section is thus possibly provided by the insulator housing or an actuating element disposed thereon or therein.

The conductor terminal may include an insulator housing having a clamping insert, which is formed from a busbar piece of this type and a clamping spring. The insulator housing may have a conductor introduction opening in the known manner (conductor introduction channel) for the purpose of guiding an electric conductor to the clamping point formed by the clamping spring and the busbar piece.

Multiple clamping inserts may also be present in the insulator housing. A busbar piece may also be part of a shared busbar for multiple clamping inserts.

An actuating element can be pivotably or movably supported in the insulator housing. The actuating element can be designed to strike an actuating section of the clamping limb during the pivoting or movement of the actuating element. An actuating element of this type may thus be used to open the clamping point for clamping the electric conductor. In addition, it may optionally be used to strike the horizontal section in the clamped state and thus stiffen the spring clamping line.

The busbar piece may have two fork tines, which are disposed at a distance from each other and are oriented to face each other for the purpose of forming a tuning fork contact socket. The contact wall is then formed by a side edge of a connecting web, which connects the two fork tines to each other. The conductor terminal thus includes not only a clamping contact for clamping an electric conductor but also a plug contact for clamping a mating contact to the tuning fork contact socket. The connecting web between the fork tines, which is needed for the fork tines, is simultaneously used as a contact wall. This contact wall is formed transversely to the fork tines, on which the vertical section of the contact limb rests. The tuning fork contact socket may thus optimally interact with the vertical section of the contact limb to support the vertical section on the connecting web of the tuning fork contact socket.

A bracket may project from the connecting web, which abuts the vertical section and faces the clamping limb. The bracket may thus not only secure the clamping spring on the busbar piece. It may also contribute to the fact that a conductor stop is formed not only by the vertical section but at least partially also by the bracket.

The busbar piece may have a wavy cross-sectional profile designed with creases and elevations in its area in which the vertical section of the contact limb is supported. Due to a profile design of this type, including creases and elevations, the busbar piece is stiffened, and the transfer of force from the contact limb to the busbar piece is improved. The wavy cross-sectional profile may be very easily implemented in the forming process for forming the busbar piece.

A horizontal section of the contact limb, which extends in the main extension direction of the busbar piece and which is disposed at a distance from the busbar piece and transitions into the spring bend, may be bent away from the vertical section of the contact limb. A holding section, which extends toward the busbar piece and is supported on the busbar piece, may projects from this horizontal section. In this way, another bearing of the horizontal section on the busbar piece is provided, together with the holding section, on the vertical section of the contact limb, on the one hand, and adjacent to the spring bend, on the other hand, with the aid of which the forces occurring at the contact insert are often effectively captured in a structurally easy and compact manner. A self-supporting, stable contact insert having a relatively stiff spring characteristic is implemented with the aid of the additional holding section.

The contact wall, which supports the vertical section, may be formed by an edge of the busbar piece facing the vertical section. It is conceivable that the contact wall is formed by an edge of a connecting web, which facing the vertical section and connects the fork tines of the busbar piece to each other and/or by an edge of a fork tine situated on the end of the fork tine opposite the clamping end of the fork tine. As a result, an edge, i.e. the narrow side of an end face of part of the busbar piece, is used as the contact wall.

The vertical section may include at least one side web, which is inserted into an assigned side recess of the busbar piece. The vertical section is thus not only supported on the contact wall but is also fixed in place on the busbar piece.

The contact limb may include a contact limb which adjoins the vertical section and is bent around from the vertical section and which abuts the clamping section of the busbar piece on the side of the clamping section facing away from the clamping limb and is situated at a distance from the clamping section in a test area. An additional planar bearing of the clamping spring on the busbar piece is provided by this contact section, which is bent away from the vertical section and engages with the clamping section of the busbar piece from below. Together with the clamping section of the busbar piece, this contact limb also forms a spring-elastic test connection for a test pin, which may be inserted between the clamping section and the contact limb in the test area. The voltage potential or signals present at the conductor terminal may thus be easily and reliably measured underneath the conductor terminal contact.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
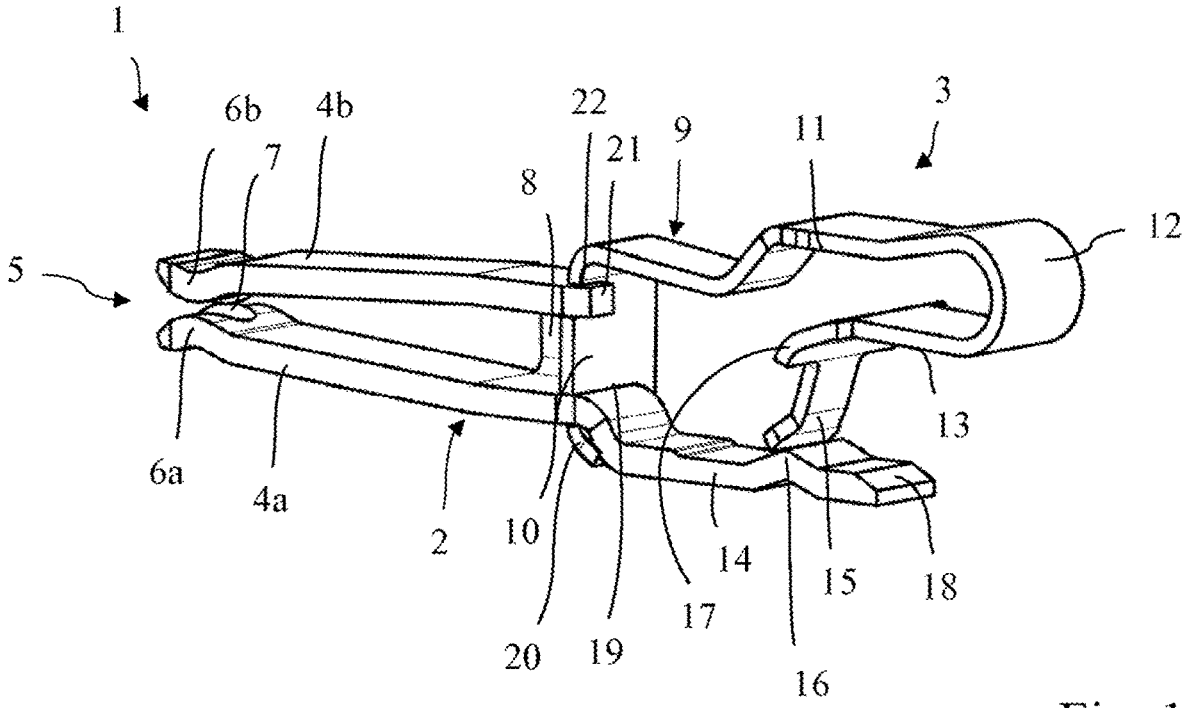
FIG. 1 shows a perspective view of a clamping insert formed from the busbar piece and the clamping spring.

A perspective view of a clamping insert 1 is apparent from FIG. 1, which is formed from a busbar piece 2 and a clamping spring 3. This clamping insert 1 may be used directly as a conductor terminal without an insulator housing. However, a conductor terminal is generally formed by a clamping insert 1 of this type, which is built into an insulator housing.

It is clear that busbar piece 2 is formed as a single piece from a metal sheet and includes a tuning fork contact socket 5, formed from two opposite fork tines 4*a*, 4*b*, on its side facing away from clamping spring 3. Fork tines 4*a*, 4*b* are oriented to face each other and each have a protrusion 6*a*, 6*b*, between which a contact pin may be plug-contacted, on their freely movable end. A trough 7 may be introduced on the opposite sides of each protrusion 6*a*, 6*b* to guide the contact pin to be clamped.

The two opposite fork tines 4*a*, 4*b* are connected to each other via a connecting web 8. This connecting web 8 projects from the side edges of fork tines 4*a*, 4*b* and is integrally formed with these fork tines 4*a*, 4*b* from the same material.

Clamping spring 3 includes a contact limb 9, which is formed from a vertical section 10 and a horizontal section 11 bent away therefrom. A spring bend 12, which transitions into a clamping limb 13, adjoins contact limb 9. Clamping limb 13 has a flexible tongue 15 oriented toward clamping section 14 extending away from lower fork tine 4*a*, whose free end has a clamping edge for clamping an electric conductor between clamping tongue 15 and clamping section 14 of busbar piece 2. Clamping section 14 has a protrusion or clamping edge 16, which forms a defined and reduced contact surface for the electric conductor clamped between clamping tongue 15 and clamping edge 16.

It is clear that clamping limb 13 has an actuating bracket 17 on at least one side, which projects laterally at least in the direction of clamping tongue 15, It is used as a support for an actuating element to displace clamping limb 13 in the direction of horizontal section 11 of contact limb 9 and away from clamping section 14 of busbar piece 2. This actuating element 17 may thus be used to open the clamping point for clamping an electric conductor.

It is furthermore clear that clamping section 14 of busbar piece 2 has a run-in bevel 18 on a free end, with the aid of which an electric conductor is guided toward clamping edge 16.

Vertical section 10 of contact limb 9 is oriented transversely to clamping section 14 of busbar piece 2 and adjoining first fork tine 4*a*. The busbar piece is inserted into a recess 19 of vertical section 10. This recess 19 is delimited by a transverse web 20, which rests on the underside of busbar piece 2, which is opposite connecting web 8. The edge of vertical section 10, which is opposite transverse web 20 and which delimits recess 19, is then supported on the upper side of the busbar piece.

Recess 19 is formed as a bay which is open on one side, so that clamping spring 3 may be pushed transversely to the extension direction of busbar piece 2.

A finger 21 is disposed on second fork tine 4*b* at a distance from recess 19, which is inserted into a notch 22 on vertical section 10 and surrounds vertical section 10. Vertical section 10 is supported on a contact wall, which is provided by the side edge of connecting web 8. Vertical section 10 of contact limb 9 is thus supported by the wall section of connecting web 8 on the side facing away from clamping limb 13 and is fixed in place by finger 21 on the side facing clamping limb 13. Vertical section 10 may also adjoin the end face or side edge of fork tine 4*b*, which is situated on the end adjoining protrusion 6*b*.

Clamping section 14 of busbar piece 2 is situated in an angled, elbowed or offset manner with respect to fork tines 4*b*, in whose extension clamping section 14 is provided, in the direction facing away from clamping spring 3. The elbowing is provided in busbar piece 2 on the side of vertical section 10 facing clamping limb 13. Transverse web 20 of vertical section 10, which is disposed on the underside of fork tine 4*b*, is bent away from or bent out of the plane of vertical section 10 in the direction of elbowed or offset clamping section 14. Transverse web 20 is supported on busbar piece 2, so that the spring forces caused by the deflection of clamping spring 3 may be captured or compensated for via this support of transverse web 20 in such a way that no elastic deformation or deflection of clamping section 14 takes place when a clamping force acts upon clamping section 14 due to the spring force of deflected clamping spring 3.

Figure 2:
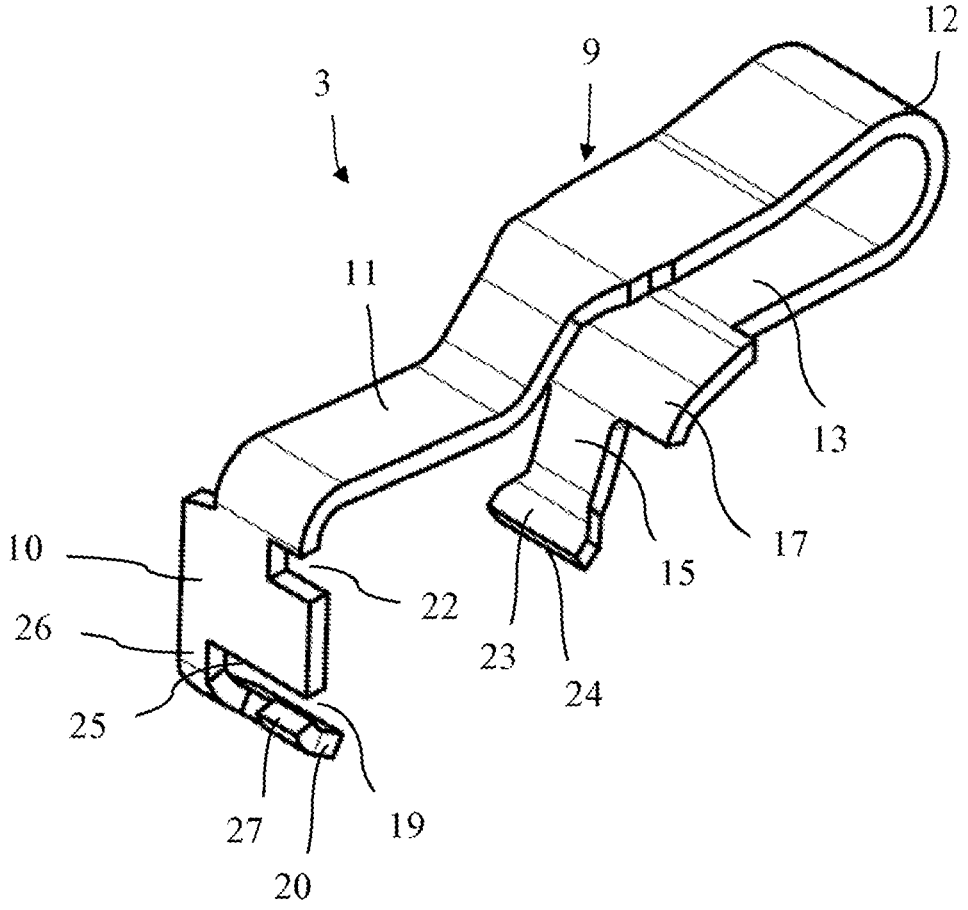
FIG. 2 shows a perspective view of the clamping spring of the clamping insert from FIG. 1.

A perspective view of clamping spring 3 is apparent from FIG. 2, which is formed from a spring sheet. This is an elastically resilient material, for example a metal sheet made from a chromium-containing alloy.

It is apparent that a spring bend 12 adjoins clamping limb 13, which connects clamping limb 13 to contact limb 9. Clamping limb 13 has a first section, which adjoins spring bend 12 and which transitions into clamping tongue 15 after a curvature. End area 23 of clamping tongue 15, including clamping edge 24, is slightly widened. An actuating bracket 17 projects laterally from the edges of clamping limb 13 on at least one side in the curvature area.

It is also clear that contact limb 19 is formed from a vertical section 11 and a vertical section 10 bent away therefrom. Horizontal section 11 may, in turn, have curvature areas to form areas situated on at least two planes.

It is apparent that vertical section 10 has a recess 19, which is delimited by a lower transverse web 20 and an edge 25 opposite transverse web 20. This recess 19 has a bay-like design, i.e. open on one side, and is delimited by a side web 26, which connects transverse web 20 to the part of vertical section 10 transitioning into horizontal section 11.

Transverse web 20 may have a lug 27 at a distance from this side web 26, with the aid of which an indentation is formed between lug 27 and side web 26. This lug 27 may be inserted into an indentation or opening of busbar piece 2 to additionally fix clamping spring 3 in place on busbar piece 2 However, it is also conceivable that a sunken part of busbar piece 2 is inserted into this indentation and that busbar piece 2 otherwise rests on lug 27.

It is furthermore clear that notch 22 is provided on vertical section 10 at a distance from recess 19, adjacent to horizontal section 11. This notch 22 is adapted to accommodate finger 21 of busbar piece 2. In this way, the fixing of clamping spring 3 in place on busbar piece 2 is improved.

Figure 3:
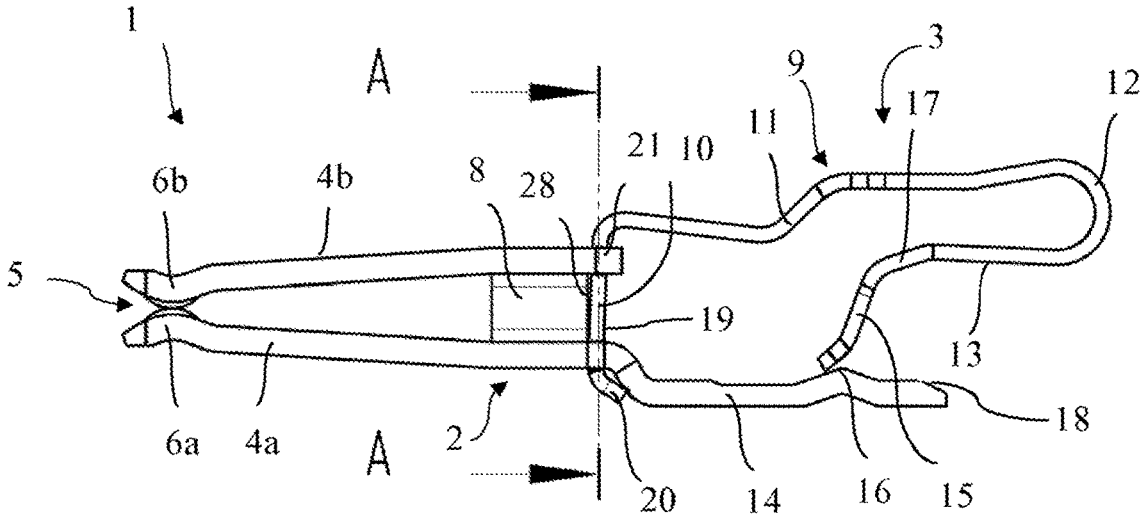
FIG. 3 shows a side view of the clamping insert from FIG. 1 with section line A-A.

FIG. 3 shows a side view of contact insert 1 from FIG. 1, including a section line A-A through vertical section 10 of clamping 3.

It is initially apparent that the two fork tines 4*a*, 4*b* disposed at a distance from each other and oriented toward each other are connected by connecting web 8 integrally formed herewith into a tuning fork contact socket 5. The narrow side edge of connecting web 8 facing clamping limb 13 forms a contact wall 28, on which vertical section 10 of clamping spring 3 is supported. It is also clear that busbar piece 2, including first fork tine 4*a* and clamping section 14 adjoined thereto, is inserted into recess 19 of vertical section 10. Transverse web 20 abuts the underside of busbar piece 2. This underside is opposite the upper side of busbar piece 2, including clamping section 14, which has clamping edge 16 for clamping the electric conductor and toward which clamping limb 13 is oriented. It is clear that clamping tongue 15 of clamping limb 13 rests upon this upper side of busbar piece 2 in clamping section 14 in the idle state when the conductor is not clamped thereon.

It is also clear that finger 21 projecting from second fork tine 4*b* is passed through vertical section 10 and surrounds vertical section 10 with its free end. Vertical section 10 thus abuts finger 21 on the side opposite the contact wall. In this way, vertical section 10 is held on contact wall 28 and rests on first fork tine 4*a* and the part of clamping section 14 of busbar piece 2 adjacent thereto.

Figure 4:
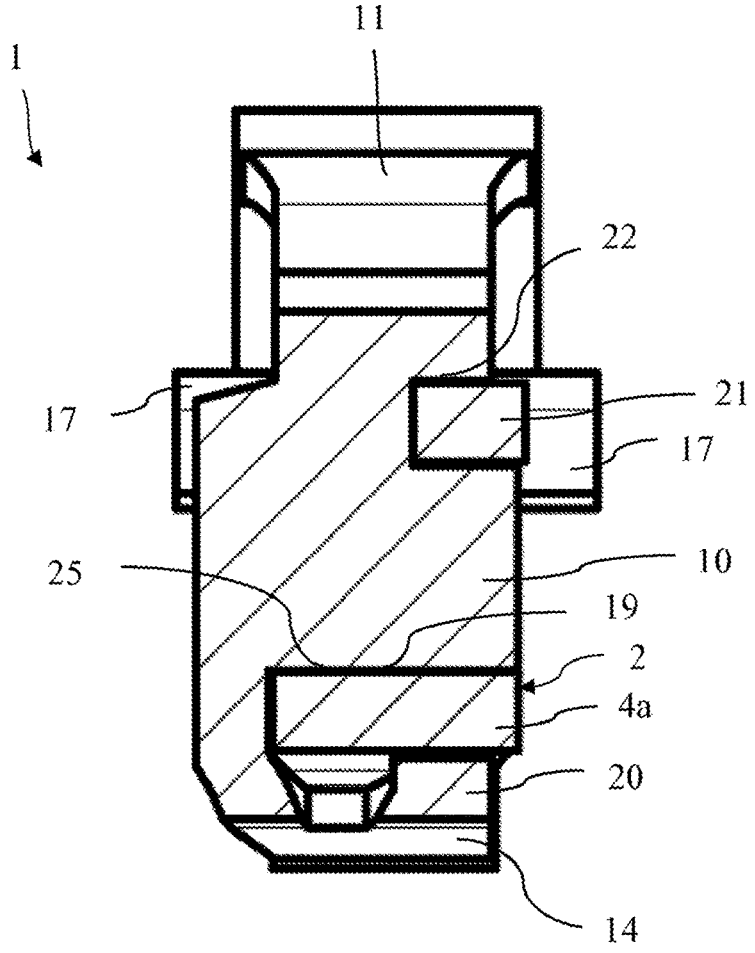
FIG. 4 shows a cross-sectional view of the clamping insert from FIG. 3 in section A-A.

FIG. 4 shows a cross-section of clamping insert 1 in section A-A. It is clear that finger 21 extends through notch 22 in vertical section 10.

It is further apparent that busbar piece 2 is inserted into recess 19 of vertical section 10 in the area of first fork tine 4*a* in the transition to clamping section 14, so that vertical section 10 rests with its upper edge 25 of recess 19 on busbar piece 2 and engages opposite transverse web 20 of busbar piece 2 from below.

The view in FIG. 4 is shown, seen from tuning fork contact socket 5 in the direction of spring bend 12, which is apparent from section line A-A in FIG. 3.

Figure 5:
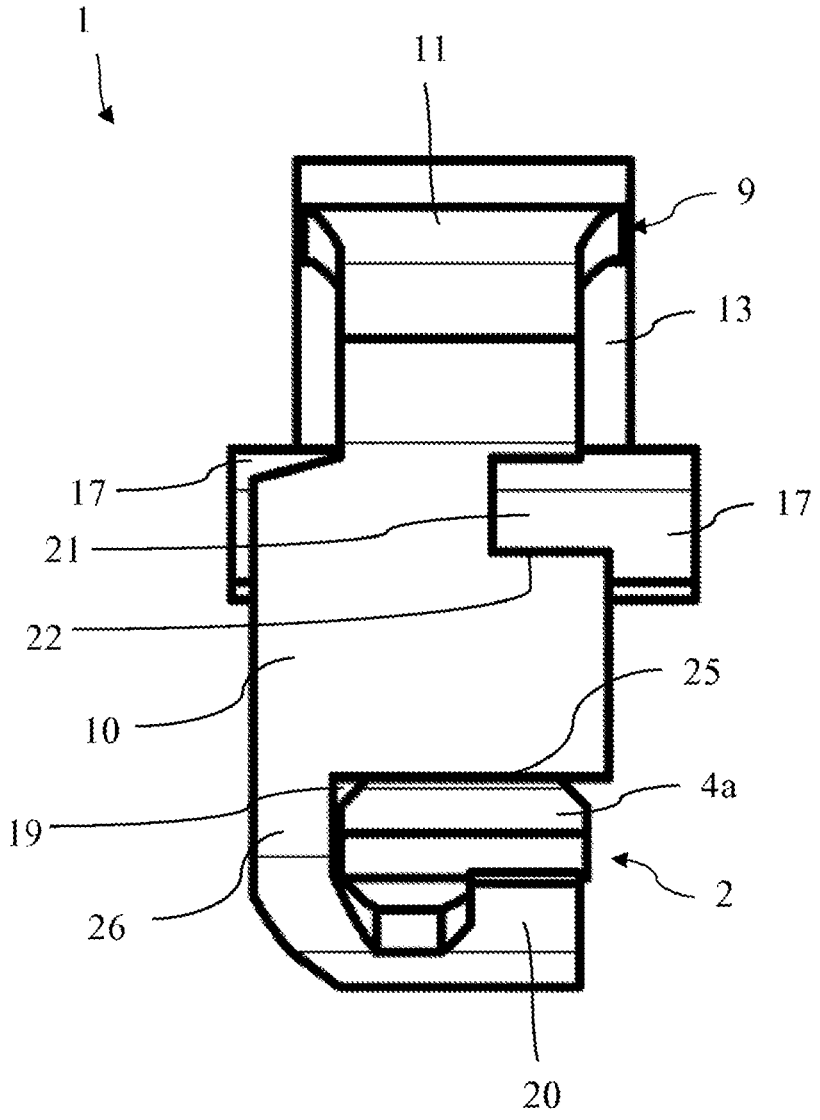
FIG. 5 shows a rear view of the vertical section of the contact limb.

FIG. 5 shows a rear view of vertical section 10 of clamping spring 3 from FIG. 2. It is even clearer that notch 19 of vertical section 10 facilitates an insertion of busbar piece 2, so that contact limb 9 may come to rest on busbar piece 2 with its upper edge 25 delimiting recess 19, and transverse web 20 delimiting recess 19 engages with busbar piece 2 from below.

It is clear that clamping spring 3 is provided to be laterally pushed onto or mounted on busbar piece 2.

Figure 6:
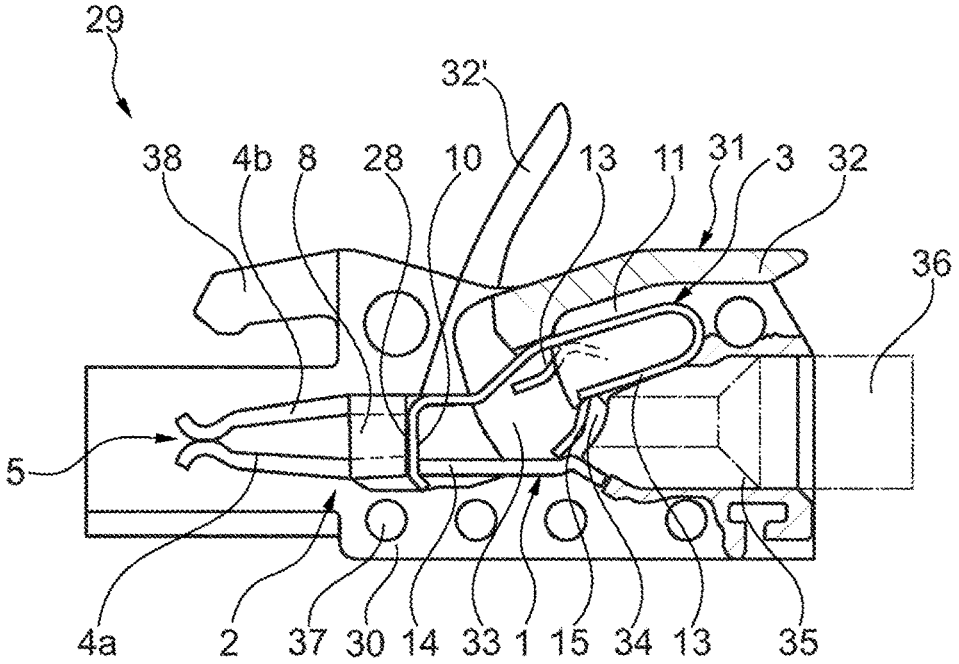
FIG. 6 shows a side view of a conductor terminal, including a contact insert from FIG. 1 and an actuating lever.

FIG. 6 shows a side view of a conductor terminal 29, which is formed from a clamping insert 3 described above and which is installed in an insulator housing 30. Insulator housing 30 also has an actuating element 31, which is designed in the illustrated exemplary embodiment as a pivotably supported actuating lever. The actuating lever includes an actuating arm 32, which extends above horizontal section 11 of clamping spring 3 and transitions into a bearing section 33 guided laterally past clamping spring 3. Bearing section 33 has an actuating contour 34, which is designed to strike laterally projecting actuating bracket 17 of clamping limb 13. When the actuating lever is pivoted upward, as outlined with actuating arm 32' in FIG. 6, clamping limb 13 is displaced away from clamping section 14 of busbar piece 2 for the purpose of opening the clamping point between clamping limb 13 and clamping section 14 in this way to clamp an electric conductor.

It is clear that insulator housing 30 has a conductor insertion opening 35 for inserting an electric conductor 36 on the side opposite tuning fork contact socket 5. The insulated end of this electric conductor 36 is then electrically conductively clamped between clamping tongue 15 of the clamping limb and clamping section 14 of busbar piece 2. It is clear that, in the flipped down state of actuating lever 31, the latter rests on horizontal section 11 for the purpose of thereby stiffening the spring characteristic of clamping spring 3.

Latching contours, e.g. in the form of latching openings 37 and latching pins, are provided on the side wall of insulator housing 30, with the aid of which multiple conductor terminals 19 may be combined one after the other into a terminal arrangement.

Adjacent to tuning fork contact socket 5, a pin 38 projects from insulator housing 30, which may be used for the purpose of guidance, latching and/or coding.

A contact pin insertion channel is present in insulator housing 30 on the side opposite conductor insertion opening 35 for the purpose of guiding a contact pin to the clamping point between fork tines 4*a*, 4*b*.

It is clearly apparent that vertical section 10 abuts contact wall 28, which is provided by the side edge of connecting web 8 between fork tines 4*a*, 4*b*.

Figure 7:
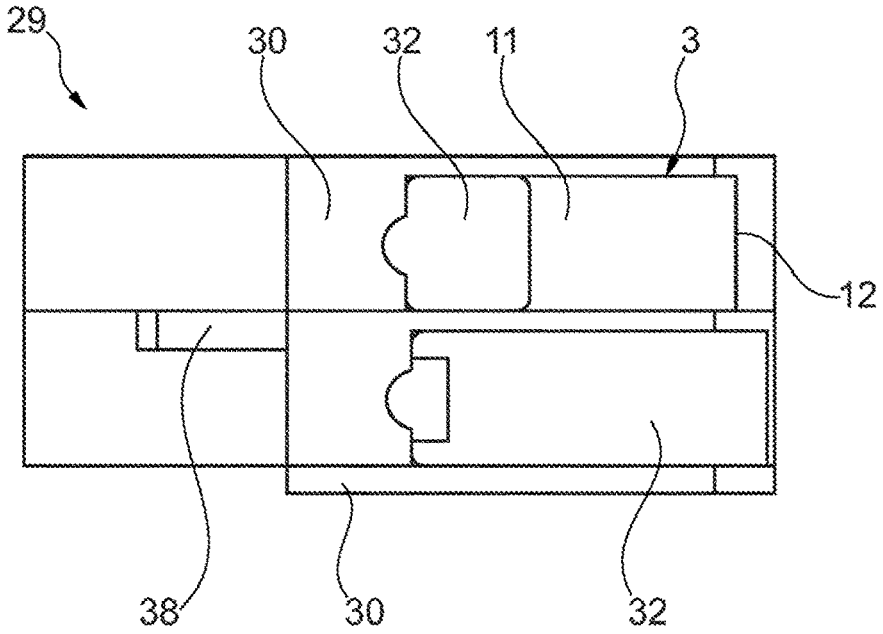
FIG. 7 shows a top view of a 2-pole conductor terminal according to FIG. 6.

A top view of a two-pole conductor terminal 29 is apparent in FIG. 7. Two insulator housings 30, including clamping inserts 1 installed therein, are disposed one next to the other and latched to each other. In the opened state, which is outlined with the upper conductor terminal, actuating arm 32 of actuating lever 31 does not cover horizontal section 11 of the clamping spring. The latter is then unable to be flexibly deflected upward, so that the spring force is further reduced during opening.

It is also clear that a pin 38 is present, for example only on one conductor terminal of two-pole conductor terminal 29. A coding may be achieved thereby.

Figure 8:
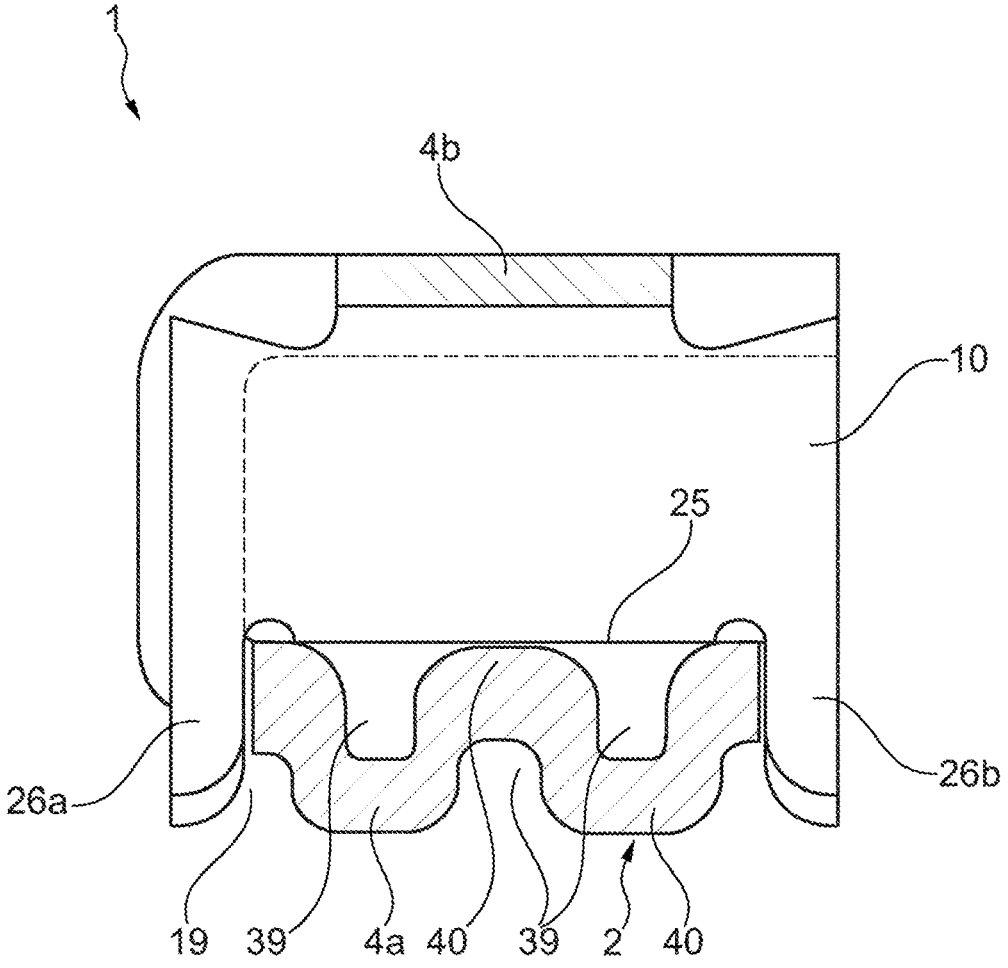
FIG. 8 shows a sectional view of an embodiment of the support of the contact limb on the busbar piece, including a wavy profile of the busbar piece.

FIG. 8 shows a cross-sectional view of a modification of contact insert 1. A recess 19 is introduced on vertical section 10, which is delimited by an upper edge 25 and side webs 26*a*, 26*b* projecting from this edge 25. Busbar piece 2 is accommodated in this recess 19 in the area of first fork tine 4*a* in the transition to holding section 14, in that it is inserted into recess 19 from below in the direction of upper edge 25. These two opposite side webs 26*a*, 26*b* then abut the side edges of busbar piece 2 or engage with recesses disposed laterally on busbar piece 2. It is clear that this design of clamping spring 3 is provided for a mounting on busbar piece 2 from above.

It is apparent that busbar piece 2 has a wavy design due to creases 39 and elevations 40 in the area inserted into recess 19. The risk of busbar piece 2 being deformed by vertical section 10 being supported on busbar piece 2 is reduced thereby. The cross section of busbar piece 2 weakened by the side recesses is reinforced by wavy creases 39 and elevations 40 to be able to absorb the forces introduced by clamping spring 3.

Figure 9:
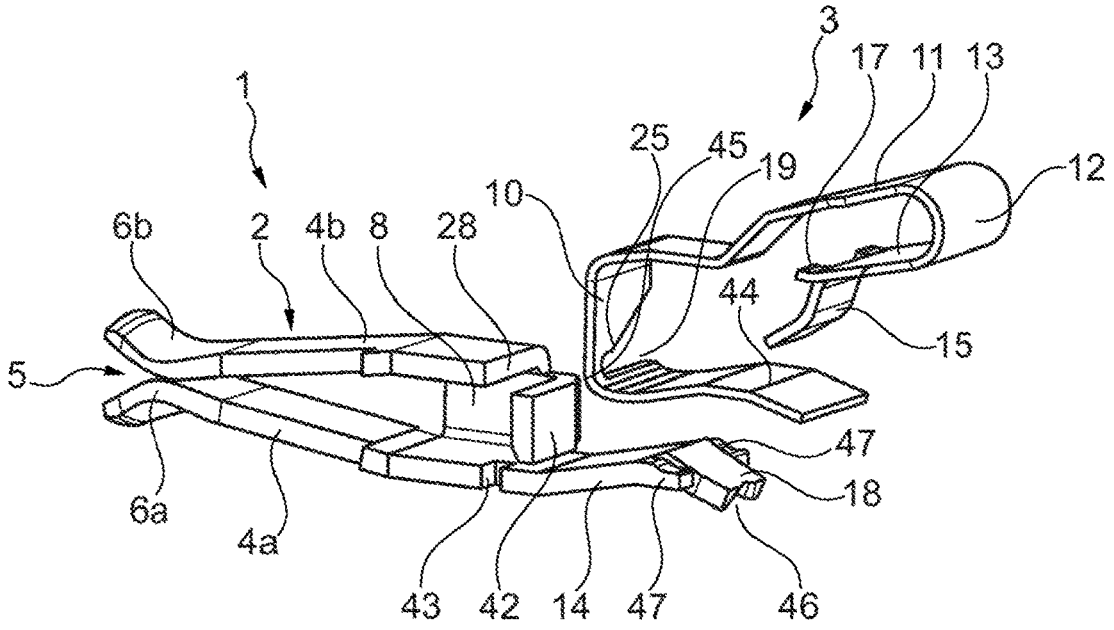
FIG. 9 shows a perspective exploded view of an embodiment of a conductor terminal, including an additional bracket on the busbar piece.

FIG. 9 shows a perspective exploded view of an embodiment of conductor terminal 1 formed from clamping spring 3 and busbar piece 2. Reference may essentially be made to the preceding discussions for the principle structure of busbar piece 2 and clamping spring 3.

It is apparent that a bracket 42 projects from connecting web 8 on the side facing clamping tongue 15 of clamping spring 3. A side recess 43 is also present in the transition between lower fork tine 4*a* and clamping section 14.

A contact section 44 projects from vertical section 10 of clamping spring 3 opposite horizontal section 11. This contact section 44 transition together with a side web 45 into vertical section 10. In addition to this side web 45, recess 19, with its edges surrounding busbar piece 2 in the installed state, is present in this transition area.

It is furthermore apparent that the free end of contact section 44 bent around from the vertical section is again bent obliquely away from clamping limb 13. A trough-like indentation 46 is also introduced on the side of run-in bevel 18 of clamping section 14, which faces away from clamping limb 13. Run-in bevel 18 is furthermore narrower in the front end area than the adjoining area of clamping section 14. Tongue-like sections 47 are present on the side next to the run-in bevel.

Figure 10:
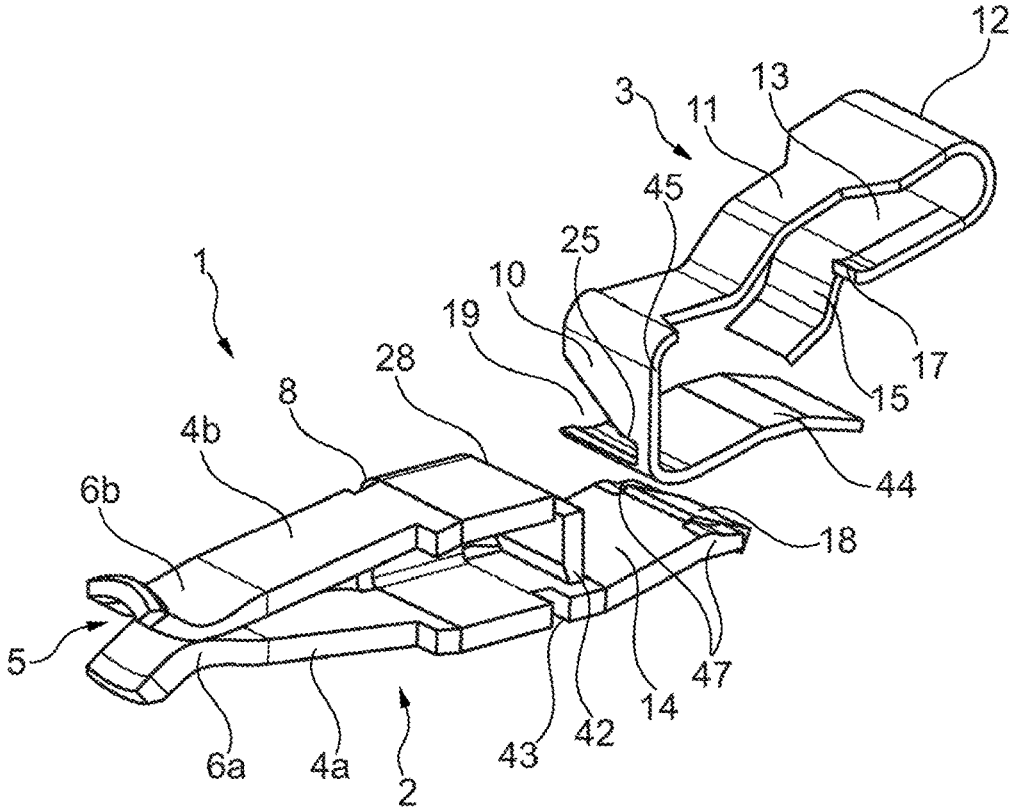
FIG. 10 shows a perspective rear view of the conductor terminal from FIG. 9.

A perspective rear view of conductor terminal 1 from FIG. 9 is apparent in FIG. 10. It is again clear that the free end of clamping section 14 ends with a run-in bevel 18 in the central area. Tongue-like sections 47, which have a shorter length than run-in bevel 18 and extend at a slightly different angle than run-in bevel 18, are present on both sides of this run-in bevel 18. The upper sides of tongue-like sections 47 are also arched in a different manner than run-in bevel 18.

It is furthermore clear that side recess 43 is positioned in such a way that it is situated upstream from bracket 42. viewed from the direction of fork tines 4*a*, 4*b*. On its side facing clamping limb 13, vertical section 10, which is inserted laterally into busbar piece 2, thus abuts bracket 42, and on its side facing away from clamping limb 13, it abuts busbar piece 2 on contact wall 28 formed by the edge of upper fork tine 4*b* and side recess 43.

Figure 11:
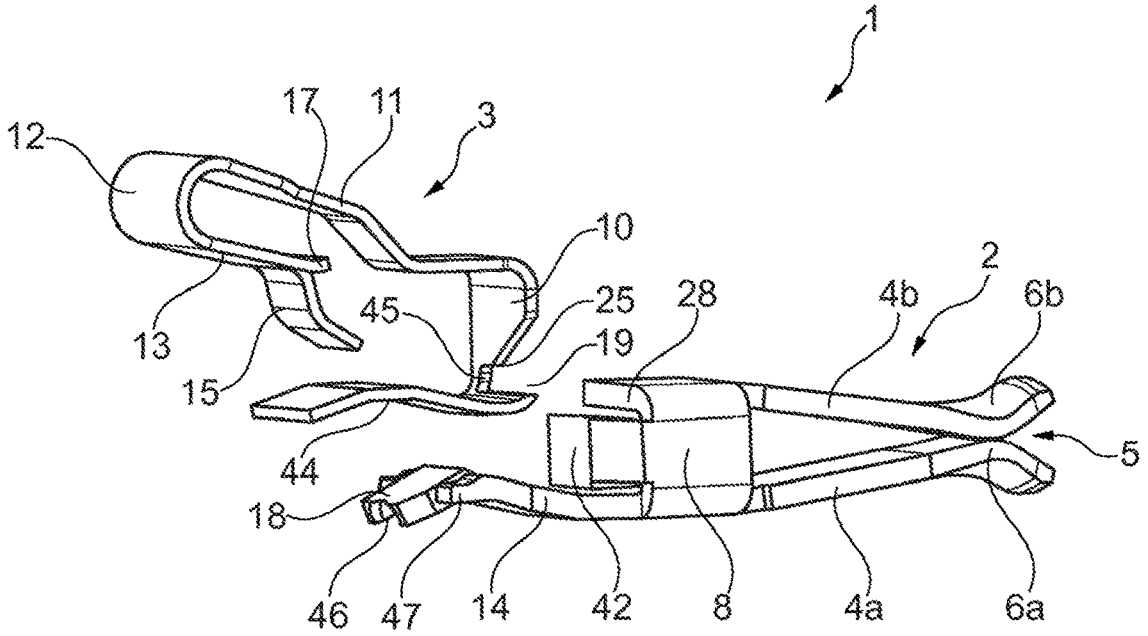
FIG. 11 shows a perspective exploded view of the conductor terminal from FIGS. 9 and 10, viewed from the opposite side.

A perspective view of conductor terminal 1 according to FIG. 9 is apparent in FIG. 11 from the opposite side. Connecting section 8 is clearly shown, which connects fork tines 4*a*, 4*b* to each other. It is furthermore apparent that a bracket 42, formed as a single piece with connecting section 8, projects therefrom.

It is furthermore apparent that a trough-like recess 46 is introduced on the underside of run-in bevel 18.

It is also apparent that clamping spring 3 may be pushed laterally onto busbar piece 2. Side web 45 is disposed on the side opposite connecting web 8. Vertical section 10 is inserted into an intermediate space between bracket 42 and contact wall 28 formed by the edge.

Figure 12:
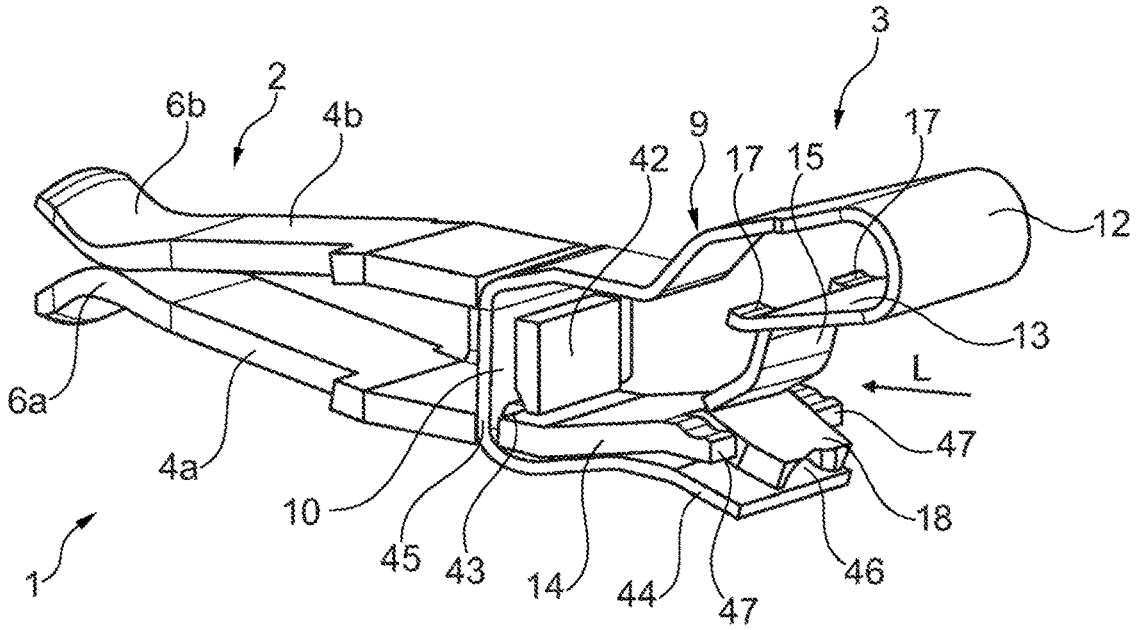
FIG. 12 shows a perspective view of the conductor terminal from FIGS. 9 through 11 in the assembled state.

This is clearly apparent in FIG. 12, which now shows conductor terminal 1 in the assembled state. It is clear that side web 45 is now inserted into side recess 43 of clamping section 14. Vertical section 10 abuts bracket 42. Bracket 42 has a surface, such that it essentially covers vertical section 10 and forms a conductor stop for an electric conductor inserted into conductor insertion device L.

It is furthermore apparent that contact section 44 of contact limb 9 bent away from vertical section 10 abuts clamping section 14 on the side of clamping section 14 opposite clamping limb 13. Contact section 44 extends up to run-in bevel 18, so that a clearance for accommodating a test pin is present between trough-like recess 46 and the free end of contact section 44. Contact section 44 is thus situated at a distance from clamping section 14 in this location.

An intermediate space, which may also be used as a test area for accommodating a test pin, is furthermore provided on the side next to introduction section 18 between shortened fingers 47 and contact section 44 situated obliquely at a distance therefrom for the purpose of measuring the voltage potential present at conductor terminal 1 or signals present in this location.

For this purpose, a test opening is present in an insulator housing beneath the conductor introduction opening.

Figure 13:
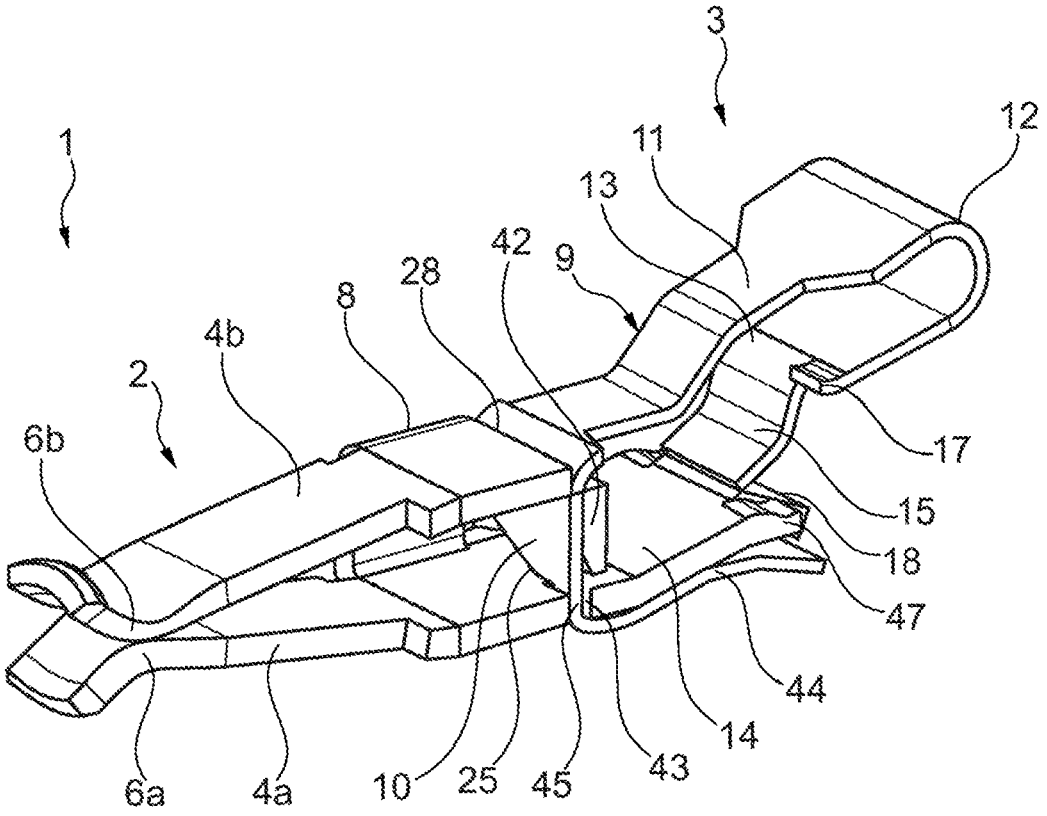
FIG. 13 shows a perspective rear view of the assembled conductor terminal from FIG. 12.

A perspective rear view of conductor terminal 1 from FIG. 12 is apparent in FIG. 13. It is once again clear that side web 45 of vertical section 10 is inserted into side recess 43 of busbar piece 2. It is clear that vertical section 10 abuts the edge of upper fork tine 4*b* facing clamping limb 15 between contact wall 28 on one side and bracket 42 on the opposite side, and an edge 25 thereof rests on clamping section 14 in the lower area. Edge 25 delimits recess 19.

The invention being thus described, it will be obvious that the same may be varied in many ways. Such variations are not to be regarded as a departure from the spirit and scope of the invention, and all such modifications as would be obvious to one skilled in the art are to be included within the scope of the following claims:

What is claimed is:

1. A conductor terminal comprising:

a bus bar piece;

a clamping spring having a clamping leg oriented towards the bus bar piece to form a clamping point to connect an electrical conductor between the clamping leg and the bus bar piece;

a spring bend adjoining the clamping leg; and a contact leg, a vertical portion of the contact leg resting on the bus bar piece and supported on a side opposite the clamping leg, the vertical portion of the contact leg having a recess; and a spring arm arranged at a distance from the bus bar piece, the spring arm being stably supported by the vertical portion, wherein the bus bar piece receives and supports the clamping spring by immersion into the recess, wherein the bus bar piece has a bearing wall that is arranged adjacent to a wall surface of the vertical portion of the contact leg, the wall surface being provided on a side of the vertical portion facing away from the clamping leg, wherein the bearing wall supports the wall surface of the vertical portion of the contact leg, wherein the conductor terminal has an insulating material housing, wherein an actuating element is pivotally or slidably mounted in the insulating material housing, and wherein the actuating element is configured to act on an actuating section of the clamping leg when pivoting or sliding the actuating element.

2. The conductor terminal according to claim 1, wherein the contact leg has a contact section adjoining the vertical portion and bent away from the vertical portion, which rests against a clamping section of the bus bar piece on a side of the clamping section facing away from the clamping leg.

3. The conductor terminal according to claim 1, wherein the vertical portion of the contact leg extends transversely to the bus bar piece.

4. The conductor terminal according to claim 1, wherein the actuating element is a pivotably mounted actuating lever.

5. The conductor terminal according to claim 4, wherein, when pivoting the actuating lever upwards, the clamping leg is moved away from a clamping section of the bus bar piece in order to open the clamping point between the clamping leg and the clamping section.

6. The conductor terminal according to claim 4, wherein the actuating lever has an actuating arm, which merges into a bearing portion laterally guided past the clamping spring.

7. The conductor terminal according to claim 6, wherein the bearing portion has an actuating contour, which is configured to act upon the clamping leg.

8. The conductor terminal according to claim 1, wherein, with the aid of the support of the vertical portion on the wall surface of the bearing wall facing away from the clamping leg, a tilting of the clamping spring is changed when the clamping leg is displaced away from the bus bar piece.

9. The conductor terminal according to claim 1, wherein the recess has marginal edges encompassing the bus bar piece.

10. The conductor terminal according to claim 1, wherein the recess is formed as a bay that is open on at least one side.

11. The conductor terminal according to claim 1, wherein the recess is formed as a bay which is open on one side, so that the clamping spring is adapted to be pushed on the bus bar piece transversely to the direction of extension of the bus bar piece.

12. The conductor terminal according to claim 1, wherein a side web of the vertical portion is immersed in a lateral recess of the bus bar piece.

13. The conductor terminal according to claim 1, wherein a marginal edge, that delimits an upper portion of the recess of the vertical portion of the contact leg, bears on an upper side of the bus bar piece, and a transverse web of the vertical portion of the contact leg, that delimits a lower portion of the recess, engages a bottom side of the bus bar piece.

14. The conductor terminal according to claim 1, wherein the vertical portion of the contact leg has an indentation at a distance from the recess and a finger of the bus bar piece protrudes from the bearing wall into the indentation.

15. The conductor terminal according to claim 14, wherein the finger engages around the vertical portion of the contact leg and an end of the finger rests on a side of the vertical portion which is located opposite the contact wall surface of the vertical portion that is supported on the bearing wall.

16. The conductor terminal according to claim 1, wherein a horizontal section of the contact leg, which extends in the main direction of extension of the bus bar piece, is bent away from the vertical portion, and wherein the horizontal section is arranged at a distance to the bus bar piece and merges into the spring bend the horizontal section forming the spring arm.

17. A conductor terminal comprising:

a bus bar piece;

a clamping spring having a clamping lea oriented towards the bus bar piece to form a clamping point to connect an electrical conductor between the clamping leg and the bus bar piece;

a spring bend adjoining the clamping leg; and a contact leg, a vertical portion of the contact leg resting on the bus bar piece and supported on a side opposite the clamping leg, the vertical portion of the contact lea having a recess; and a spring arm arranged at a distance from the bus bar piece, the spring arm being stably supported by the vertical portion, wherein the bus bar piece receives and supports the clamping spring by immersion into the recess, wherein the bus bar piece has a bearing wall that is arranged adjacent to a wall surface of the vertical portion of the contact leg, the wall surface being provided on a side of the vertical portion facing away from the clamping leg, wherein the bearing wall supports the wall surface of the vertical portion of the contact leg, wherein the conductor terminal has an insulating material housing, wherein an actuating element is pivotally or slidably mounted in the insulating material housing, wherein the actuating element is configured to act on an actuating section of the clamping leg when pivoting or sliding the actuating element, wherein a horizontal section of the contact leg, which extends in the main direction of extension of the bus bar piece, is bent away from the vertical portion, and wherein the horizontal section is arranged at a distance to the bus bar piece and merges into the spring bend, the horizontal section forming the spring arm, and wherein the horizontal section has no support on the bus bar piece.

18. The conductor terminal according to claim 1, wherein the actuating section of the clamping leg is configured as a laterally protruding actuating tab.

19. The conductor terminal according to claim 1, wherein the clamping leg has an actuating tab on at least one side, which laterally projects at least towards a clamping tongue.

20. A conductor terminal comprising:

a bus bar piece;

a clamping spring having a clamping leg oriented towards the bus bar piece to form a clamping point to connect an electrical conductor between the clamping leg and the bus bar piece;

a spring bend adjoining the clamping leg; and a contact leg, a vertical portion of the contact leg resting on the bus bar piece and supported on a side opposite the clamping leg, the vertical portion of the contact leg having a recess; and a spring arm arranged at a distance from the bus bar piece, the spring arm being stably supported by the vertical portion, wherein the bus bar piece receives and supports the clamping spring by immersion into the recess, wherein the bus bar piece has a bearing wall that is arranged adjacent to a wall surface of the vertical portion of the contact leg, the wall surface being provided on a side of the vertical portion facing away from the clamping leg, wherein the bearing wall supports the wall surface of the vertical portion of the contact leg, wherein the conductor terminal has an insulating material housing, wherein an actuating element is pivotally or slidably mounted in the insulating material housing, wherein the actuating element is configured to act on an actuating section of the clamping leg when pivoting or sliding the actuating element, wherein the actuating section of the clamping leg is configured as a laterally protruding actuating tab, and wherein the actuating tab is a support for an actuating element to move the clamping leg in a direction of a horizontal section of the contact leg and away from the clamping section of the bus bar piece.

21. The conductor terminal according to claim 1, wherein the bus bar piece has two fork prongs that are arranged at a distance from one another and are oriented facing one another to form a fork plug contact socket.

22. The conductor terminal according to claim 21, wherein, from a connecting web interconnecting the two fork prongs, a tab projects that rests against the vertical portion and faces the clamping leg.

23. The conductor terminal according to claim 22, wherein the tab is formed in one piece with the connecting web.

24. The conductor terminal according to claim 22, wherein the tab has a surface configured to substantially cover the vertical portion and at least partially form a conductor stop via the vertical portion.

25. The conductor terminal according to claim 21, wherein the insulating material housing has a conductor insertion opening or a conductor insertion channel for the insertion of an electrical conductor on the side which is opposite the fork plug contact socket.

26. The conductor terminal according to claim 1, wherein the contact section merges into the vertical portion with a side web, and wherein in this transition region, the recess with marginal edges encompassing the bus bar piece in the installed condition is present next to the side web.

27. The conductor terminal according to claim 26, wherein a free end of the contact section bent away from the vertical portion is bent obliquely away from the clamping leg.

28. The conductor terminal according to claim 1, wherein the vertical portion of the contact leg rests on the bus bar piece on the side opposite the clamping leg in a conductor insertion direction, such that, in the conductor insertion direction, a position at which the vertical portion of the contact leg rests on the bus bar piece is spaced apart from the clamping point between the clamping leg and the bus bar piece in which the electrical conductor is connected between the clamping leg and the bus bar piece.

* * * * *